United States Patent [19]

Trimble

[11] Patent Number: 4,771,502

[45] Date of Patent: Sep. 20, 1988

[54] TOWEL AND METHOD OF MAKING SAME

[76] Inventor: Harold J. Trimble, 7151 W. Hwy 98 (Box 72), Panama City Beach, Fla. 32407

[21] Appl. No.: 95,999

[22] Filed: Sep. 14, 1987

[51] Int. Cl.[4] ..... A41D 27/00

[52] U.S. Cl. ..... 15/209 R; 29/525.1; 2/279

[58] Field of Search ..... 15/209 R, 210 R, 208; D6/608; 29/526 R, 400 C; 2/279; 223/37, 66

[56] References Cited

U.S. PATENT DOCUMENTS

| | | | |
|---|---|---|---|
| 1,478,112 | 12/1923 | Flather | 15/209 R |
| 2,727,515 | 12/1955 | Hoff | 15/209 R |
| 2,754,532 | 7/1956 | Kanehl et al. | D6/608 |
| 2,777,133 | 1/1957 | Phillips, Jr. | 2/279 |
| 2,966,685 | 1/1961 | Kausnicka | 2/279 |
| 3,040,357 | 6/1962 | Belleni | 15/223 |
| 3,512,182 | 5/1970 | Bezanilla | 2/279 |
| 3,760,461 | 9/1973 | Wright | 15/209 R |
| 4,004,315 | 1/1977 | Rials | 15/209 R |
| 4,224,712 | 9/1980 | Black et al. | 15/209 R |
| 4,403,366 | 9/1983 | Lucke | 15/209 R |

*Primary Examiner*—Philip R. Coe
*Assistant Examiner*—J. Dwight Poffenberger, Jr.
*Attorney, Agent, or Firm*—John Wade Carpenter

[57] ABSTRACT

Disclosed are a towel adapted to be worn by the user and a method of making such towel. A single sheet of absorbent and pliant fabric material is cut such as to have a top end and a bottom end opposed to the top end and a first side and a second side opposed to the first side. A stiffening member is disposed against the fabric towel material. The top end is folded over to form a top fold. The first side edge is folded over and against the stiffening member to form a first rear towel face. The second side edge is folded over and against the first rear towel face. The stiffening member is encapsulated in the fabric towel material by securing the various towel faces together underneath the stiffening member and securing together the tops of the various folded towel material.

9 Claims, 3 Drawing Sheets

FIG. 1
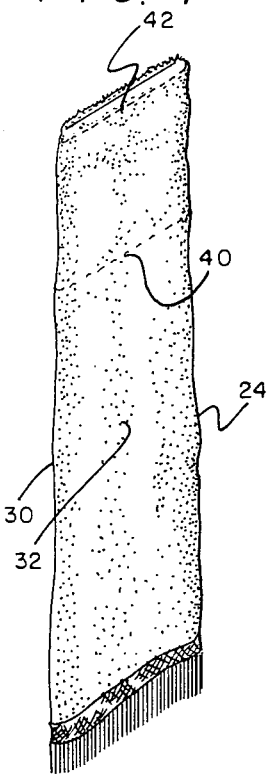
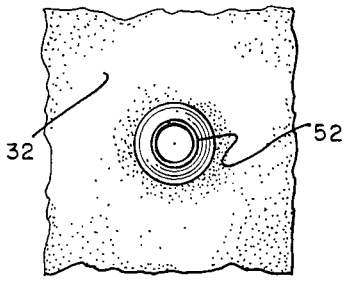
FIG. 6
FIG. 2
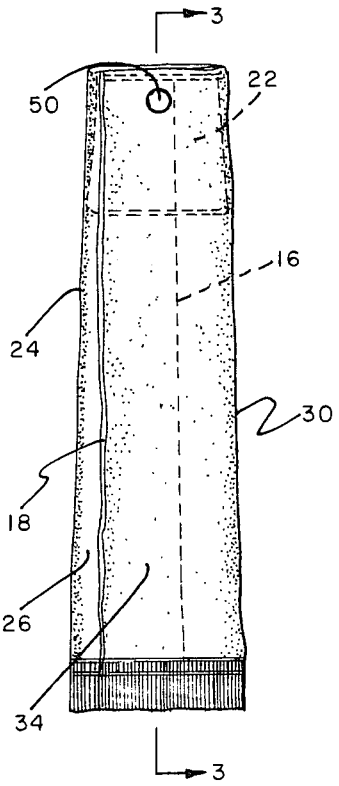
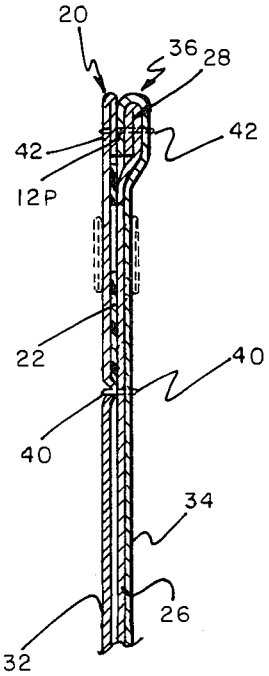
FIG. 3
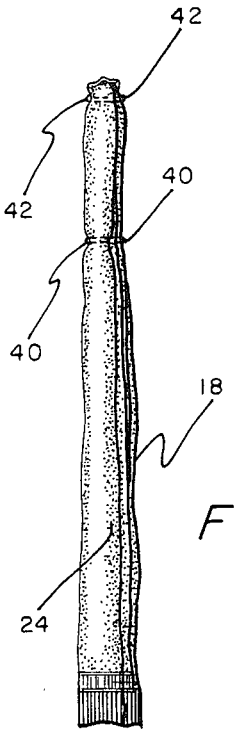
FIG. 4
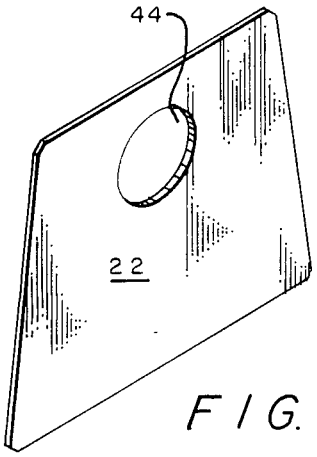
FIG. 5

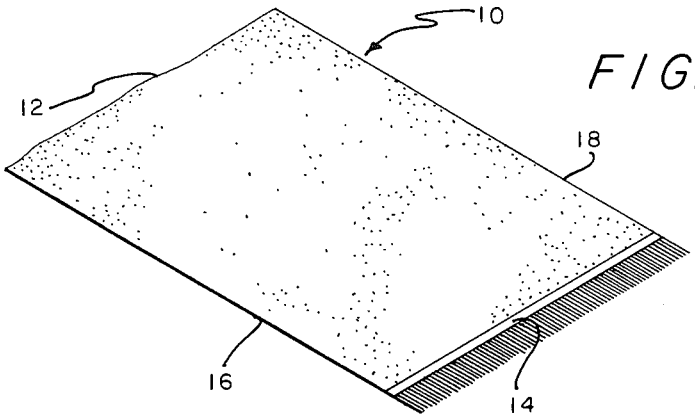
FIG. 7
FIG. 8
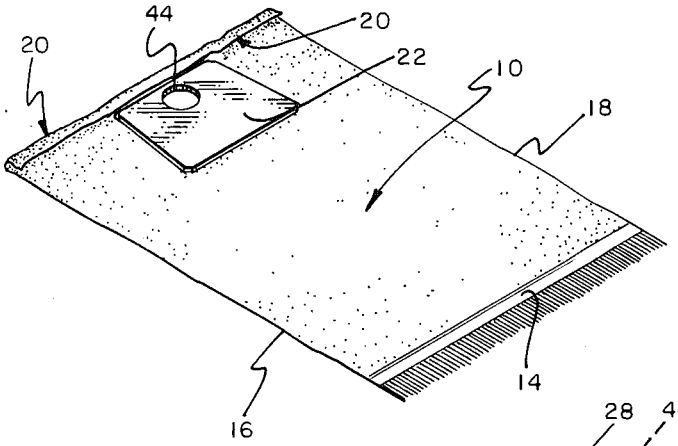
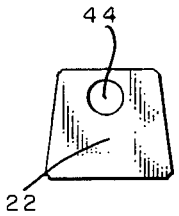
FIG. 9
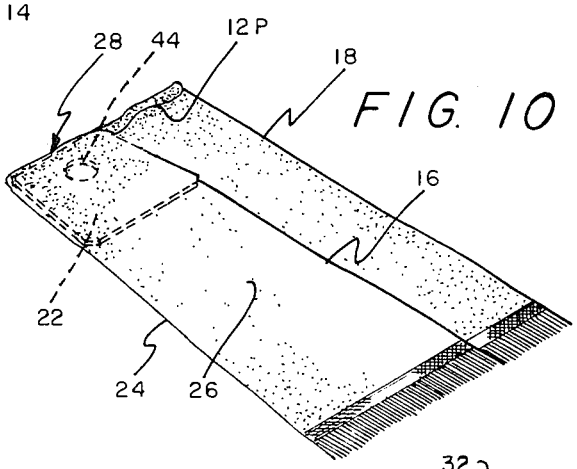
FIG. 10
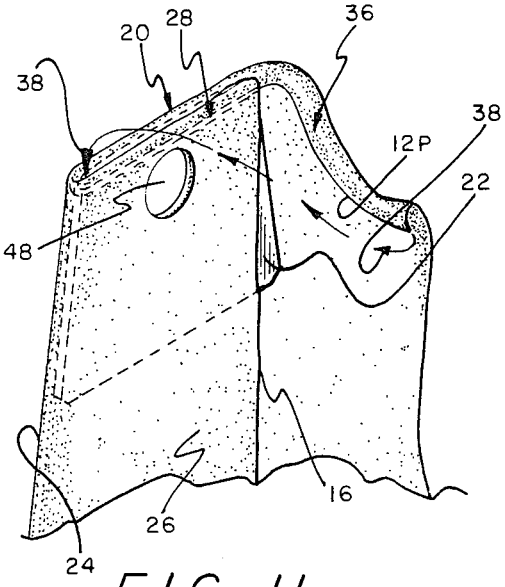
FIG. 11
FIG. 12
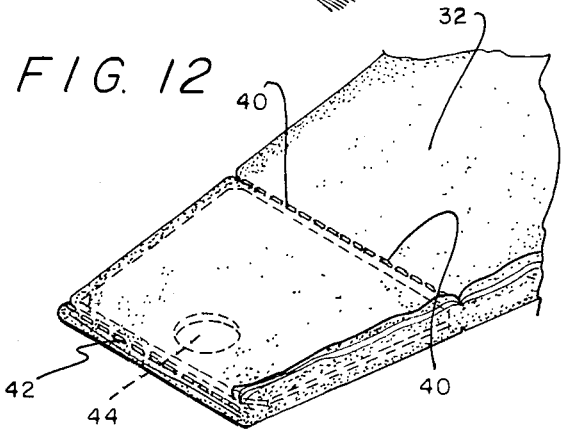

TOWEL AND METHOD OF MAKING SAME

FIELD OF THE INVENTION

This invention is related to a towel having a stiffening member to facilitate the wear or use by a user. More specifically, this invention provides a towel with a stiffening member and a method for making the same.

DESCRIPTION OF THE PRIOR ART

The following U.S. patents were discovered in a patentability investigation: U.S. Pat. Nos. 2,727,515; 2,966,685; 3,040,357; 4,224,712; 2,777,133; 3,512,182; 4,004,315; and 3,760,461. None of the foregoing prior art patents teach or suggest the particular towel and method for making same of this invention.

SUMMARY OF THE INVENTION

The present invention accomplishes its desired objects by broadly providing a method for forming a towel with a stiffening member comprising the following steps:

(a) providing a single sheet of absorbent and pliant fabric towel material having a top end and a bottom end opposed to the top end and a first side and a second side opposed to the first side;

(b) disposing a stiffening member on said fabric towel material;

(c) folding said top end over and down against the fabric towel material to form a top fold;

(d) folding said first side edge over and against said stiffening member to form a first longitudinal fold and a first rear towel face and to interrupt said top fold to form a first rear top fold that is folded against said top fold;

(e) folding said second side edge over and against said first rear towel face to form a second longitudinal fold and a front towel face between the first longitudinal fold and the second longitudinal fold and to form a second rear towel face and to interrupt said top fold to further form a second rear top fold including a portion of said top end;

(f) inserting said portion of said top end of step (e) over said first rear top fold and lodging the same between said top fold and said first rear top fold;

(g) securing together the front towel face, the first rear towel face and the second rear towel face underneath the stiffening member to hold the fabric towel material in a folded position and to assist in retaining the stiffening member within the folded fabric towel material; and (h) securing together the top fold, the first rear top fold and the second rear top fold for further holding the fabric towel material in a folded position and to further assist in retaining the stiffening member within the folded fabric towel material.

It is therefore an object of the present invention to provide a towel.

It is another object of the present invention to provide a method for making a towel that encloses or encapsulates a stiffening member.

These, together with the various ancillary objects and features which will become apparent to those skilled in the art as the following description proceeds, are attained by this novel towel and method, a preferred embodiment being shown with reference to the accompanying drawings, by way of example only, wherein:

BRIEF DESCRIPTION OF THE DRAWINGS

FIG. 1 is a perspective view of the towel of this invention;

FIG. 2 is a rear elevational view of the towel;

FIG. 3 is a vertical sectional view taken in direction of the arrows and along the plane of line 3—3 in FIG. 3;

FIG. 4 is a side elevational view of the towel;

FIG. 5 is a perspective view of the stiffening member;

FIG. 6 is a partial top plan view disclosing the embodiment of the towel that employs a grommet;

FIG. 7 is a perspective view of a single sheet of towel material wherefrom the towel is to be manufactured;

FIG. 8 is a perspective view of the towel material of FIG. 7 with the top end folded over and the stiffening member disposed thereon;

FIG. 9 is a front elevational view of the stiffening member;

FIG. 10 is a perspective view of the towel material of FIG. 8 after a side has been folded over and against the stiffening member;

FIG. 11 is a partial perspective view of the towel of FIG. 10 including arrows illustrating where the end portion of the remaining side of the towel of FIG. 10 is to lodge when the remaining side is folded over and onto the first folded side;

FIG. 12 is a partial perspective view of one embodiment of the towel without the grommet and having a pair of stitching within the material of the towel above and below the stiffening member to encapsulate or enclose the stiffening member and to maintain the towel in a folded position;

DETAILED DESCRIPTION OF THE INVENTION

Figure 13:
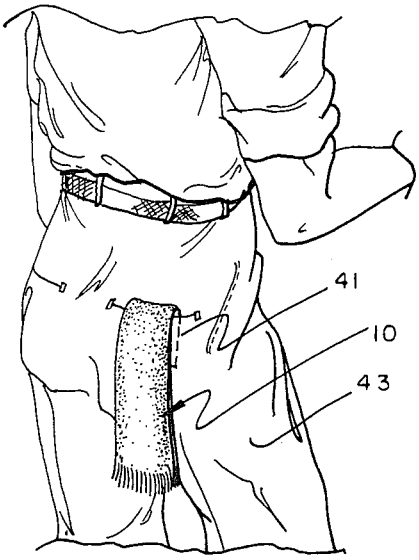
FIG. 13 is a perspective view of a user wearing the towel in a rear pocket by the encapsulated or enclosed stiffening member being inserted therein.

Referring in detail now to the drawings wherein similar parts of the invention are identified by like reference numerals, a single sheet of absorbent and pliant fabric towel material, generally illustrated as 10, is formed to have a top end 12, a bottom end 14 opposed to the top end 12, a first side 16, and a second side 18 that is opposed to the first side 16. The top end 12 is folded downwardly toward the bottom end 14 and against the material of the fabric towel 10 as illustrated in FIG. 8 to form a top fold, generally illustrated as 20 in FIG. 8. A stiffening member 22 (preferably trapezoidal in shape) is disposed on and against the material of the fabric towel 10 as illustrated also in FIG. 8. The stiffening member 22 may be manufactured from any suitable material, but is preferably manufactured from a flexible water-proof material such as plastic.

The first side 16 is folded over and onto and/or against the stiffening member 22 to form a longitudinal fold 24 and a first rear towel face 26. The folding of the first side 16 also interrupts the top fold 20 to form a first rear top fold 28 that is folded or imposed against the top fold 20 as illustrated in FIGS. 10 or 11. The second side 18 is folded over and onto and/or against the first rear towel face 26 to form a longitudinal fold 30 and a front towel face 32 (see FIGS. 1 and 12) between the longitudinal folds 24 and 30. The folding of the second side 18 also forms a second rear towel face 34 and a second rear top fold 36 by interrupting the top fold 20 (see FIG. 11). The second rear top fold 36 has a portion of the top end 12, which is identified as 12*p* in FIGS. 10 and 11. This portion 12*p* of the top end 12 is looped over the first rear top fold 28 as illustrated by arrows 38 in FIG. 11 and is lodged between the top fold 20 and the first rear top fold 28 as illustrated in FIG. 3. A stitching 40 is provided as a fastening means for holding the material of the fabric towel 10 in a folded position and to assist in retaining the stiffening member 22 encapsulated and within the material of the folded fabric towel 10. The stitching 40, as illustrated in FIGS. 3 and 12, engages the material of the fabric towel 10 underneath the stiffening member 22; more specifically, stitching 40 extends transversely across the front towel face 32, the first rear towel face 26, and the second rear towel face 34.

Figure 14:
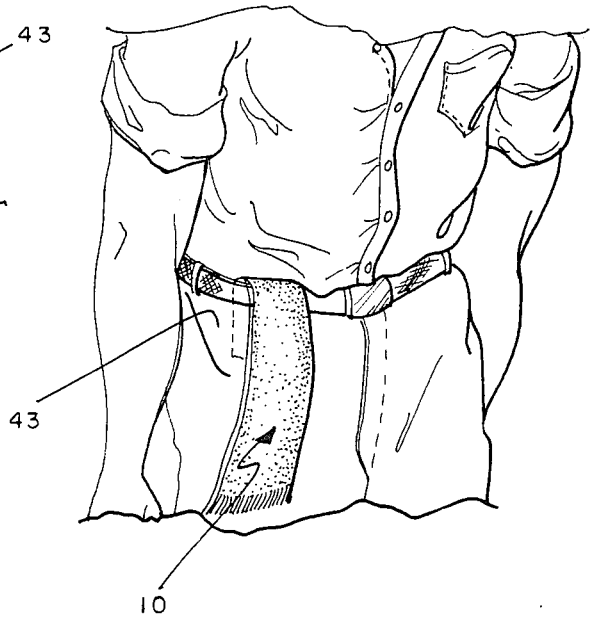
FIG. 14 is a partial perspective view of a user wearing the towel between a front waist band of pants and the body by the encapsulated or enclosed stiffening member being lodged therebetween.
Figure 16:
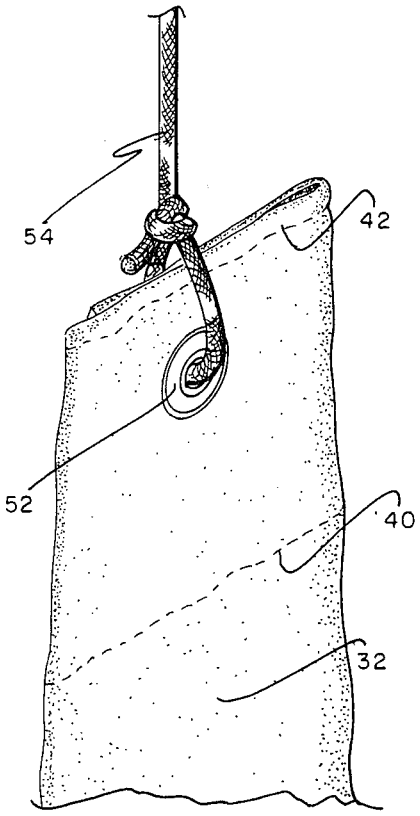
FIG. 16 is a partial perspective view of the towel having a grommet with a rope having one end passing securedly through the grommet with the other end of the rope being available to be attached to apparel or the body of the user.
Figure 15:
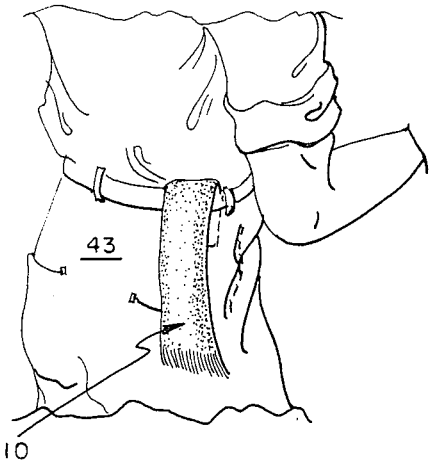
FIG. 15 is a partial perspective view of the user wearing the towel between a rear waist band of pants and the body by the encapsulated or enclosed stiffening member being lodged therebetween.

A stitching 42 is also provided as a fastener for holding the material of the fabric towel 10 in a folded position and to also or further assist in retaining the stiffening member 22 encapsulated and within the material of the folded fabric towel 10. The stitching 42 engages the top fold 20, the first rear top fold 28, and the second rear top fold 36 above the stiffening member 22. More specifically, stitching 42 extends transversely across the top of the front towel face 32 passing through the top fold 20, the portion 12*p* of the top end 12, the first rear top fold 28, and the top of the second rear towel face 34 (as well as the top of the first rear towel face 26 which is disposed underneath the second rear towel face 34). The fabric towel material 10 with the encapsulated or enclosed stiffening member 22 may be worn by a user in a number of ways, such as illustrated in FIGS. 13–15. In FIG. 13, the encapsulated or enclosed stiffening member 22 is inserted into a rear pocket 41 of pants 43. In FIG. 14, the encapsulated or enclosed stiffening member 22 is inserted between the front waist and the pants 43, whereas in FIG. 15 the encapsulated or enclosed stiffening member 22 is lodged between the rear waist and the pants 43. Obviously, there are other ways of wearing the fabric towel 10 of this invention.

In one preferred embodiment of the invention, the stiffening member 22 has an aperture 44 which registers and communicates with apertures 46, 48, and 50 in the front towel face 32, the first rear towel face 26, and the second rear towel face 34, respectively. A grommet 52 is secured around the periphery of the aperture 44, as well as apertures 46, 48, and 50. A rope 54 may be used to pass through the grommet 52 and tie to the user's apparel or body.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A towel comprising a single sheet of absorbent and pliant fabric towel material having a top end and a bottom end opposed to the top end and a first side and a second side opposed to the first side; a stiffening member disposed against said fabric towel material; said top end being folded over to define a top fold, said first side edge being folded over onto and against said stiffening member to form a first longitudinal fold and a first rear towel face and to interrupt said top fold to form a first rear top fold that is folded against said top fold, said second side edge being folded over onto and against said first rear towel face to form a second longitudinal fold and a front towel face between the first longitudinal fold and the second longitudinal fold and to form a second rear towel face and to interrupt said top fold to further form a second rear top fold including a portion of said top end, said portion of said top end looping over said first rear top fold and lodging between said top fold and said first rear top fold; a first fastening means engaging the fabric towel material underneath the stiffening member for holding the fabric towel material in a folded position and to assist in retaining the stiffening member within the folded fabric towel material; and a second fastening means engaging the top fold, the first rear top fold, and the second rear top fold for holding the fabric towel material in a folded position and to assist in retaining the stiffening member within the folded fabric towel material.

2. The towel of claim 1 wherein said first fastening means is stitching extending transversely across the front towel face, the first rear towel face and the second rear towel face.

3. The towel of claim 1 wherein said second fastening means is stitching extending transversely across the top of the front towel face passing through the top fold, the portion of said top end, said first rear top fold, and the top of said second rear towel face.

4. The towel of claim 1 wherein said stiffening member has a structure defining a stiffening aperture, said folded fabric towel material has a towel aperture passing through said front towel face, said first rear towel face, and said second rear towel face; and said towel aperture is aligned with said stiffening aperture.

5. The towel of claim 4 additionally comprising a grommet means secured around the periphery of the towel aperture.

6. A method for forming a towel including the following steps of:

(a) providing a single sheet of absorbent and pliant fabric towel material having a top end and a bottom end opposed to the top end and a first side and a second side opposed to the first side;

(b) disposing a stiffening member on said fabric towel material;

(c) folding said top end over and down against the fabric towel material to form a top fold;

(d) folding said first side edge over and against said stiffening member to form a first longitudinal fold and a first rear towel face and to interrupt said top fold to form a first rear top fold that is folded against said top fold;

(e) folding said second side edge over and against said first rear towel face to form a second longitudinal fold and a front towel face between the first longitudinal fold and the second longitudinal fold and to form a second rear towel face and to interrupt said top fold to further form a second rear top fold including a portion of said top end;

(f) inserting said portion of said top end of step (e) over said first rear top fold and lodging the same between said top fold and said first rear top fold;

(g) securing together the front towel face, the first rear towel face, and the second rear towel face underneath the stiffening member to hold the fabric towel material in a folded position and to assist in retaining the stiffening member within the folded fabric towel material; and (h) securing together the top fold, the first rear top fold and the second rear top fold for further holding the fabric towel material in a folded position and to further assist in retaining the stiffening member within the folded fabric towel material.

7. The method for forming a towel of claim 6 additionally comprising providing a stiffening aperture in said stiffening member.

8. The method for forming a towel of claim 7 additionally comprising forming an aperture in the front towel face, in the first rear towel face, and in the second rear towel face.

9. The method for forming a towel of claim 8 additionally comprising positioning a grommet around said stiffening aperture and said aperture.

* * * * *